US009448504B2

(12) United States Patent
Yoshinaga

(10) Patent No.: US 9,448,504 B2
(45) Date of Patent: Sep. 20, 2016

(54) DEVELOPING ROLLER

(71) Applicant: SUMITOMO RUBBER INDUSTRIES, LTD., Kobe-shi, Hyogo (JP)

(72) Inventor: Hisao Yoshinaga, Kobe (JP)

(73) Assignee: SUMITOMO RUBBER INDUSTRIES, LTD., Kobe-shi (JP)

( * ) Notice: Subject to any disclaimer, the term of this patent is extended or adjusted under 35 U.S.C. 154(b) by 0 days.

(21) Appl. No.: 14/995,815

(22) Filed: Jan. 14, 2016

(65) Prior Publication Data

US 2016/0223938 A1 Aug. 4, 2016

(30) Foreign Application Priority Data

Feb. 3, 2015 (JP) ..... 2015-019576

(51) Int. Cl.
*G03G 15/08* (2006.01)

(52) U.S. Cl.
CPC ..... *G03G 15/0808* (2013.01)

(58) Field of Classification Search
CPC ..... G03G 15/0808
USPC ..... 399/286; 156/85
See application file for complete search history.

(56) References Cited

U.S. PATENT DOCUMENTS

| | | | | |
|---|---|---|---|---|
| 5,548,382 | A * | 8/1996 | Koshi | G03G 15/0812 399/260 |
| 2002/0114649 | A1* | 8/2002 | Ohuchi | G03G 15/0818 399/286 |
| 2009/0142107 | A1 | 6/2009 | Akira et al. | |
| 2010/0143008 | A1* | 6/2010 | Mizumoto | G03G 15/0812 399/286 |
| 2011/0003089 | A1* | 1/2011 | Meguriya | G03G 15/2057 428/1.1 |
| 2012/0222796 | A1* | 9/2012 | Kamimura | B29C 65/18 156/85 |

FOREIGN PATENT DOCUMENTS

| | | |
|---|---|---|
| JP | 2002-189341 A | 7/2002 |
| JP | 2008-145885 A | 6/2008 |
| JP | 2009-150949 A | 7/2009 |

* cited by examiner

*Primary Examiner* — Quana M Grainger
(74) *Attorney, Agent, or Firm* — Birch, Stewart, Kolasch & Birch, LLP

(57) ABSTRACT

A roller (1) is provided, which is free from imaging failures even if being used as a developing roller, for example, in combination with a toner including highly spherical toner particles or a lower-melting-point toner. The roller (1) includes a tubular body made of a crosslinking product of a rubber composition containing a crosslinkable rubber component, and having a heat conductivity of 0.4 to 2.0 W/m·K and a Type-A durometer hardness of 50 to 70.

4 Claims, 1 Drawing Sheet

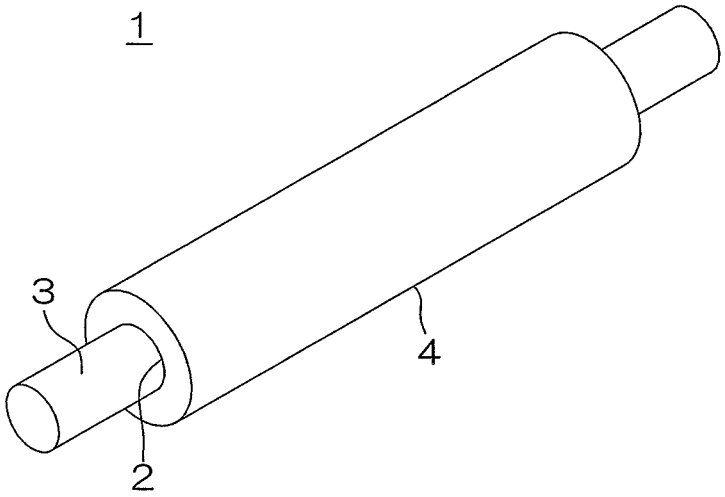
1
3
4
2

DEVELOPING ROLLER

TECHNICAL FIELD

The present invention relates to a roller to be advantageously used as a developing roller and the like, for example, in an electrophotographic image forming apparatus.

BACKGROUND ART

In an electrophotographic image forming apparatus such as a laser printer, an electrostatic copying machine, a plain paper facsimile machine or a printer-copier-facsimile multifunction machine, an electrostatic latent image formed on a surface of a photoreceptor body by electrically charging the photoreceptor surface and exposing the photoreceptor surface to light is developed into a toner image with a toner, and a developing roller is used for the development.

For the development of the electrostatic latent image into the toner image by the developing roller, the developing roller is rotated in contact with an amount regulating blade (charging blade) in a developing device containing the toner.

Thus, the toner contained in the developing device is triboelectrically charged and applied onto an outer peripheral surface of the developing roller. At the same time, the amount of the applied toner is regulated by the amount regulating blade, whereby a toner layer is formed on the outer peripheral surface of the developing roller as having a generally constant thickness.

When the developing roller is further rotated in this state to transport the toner layer to the vicinity of the surface of the photoreceptor body, the toner of the toner layer is selectively transferred from the toner layer to the surface of the photoreceptor body according to the electrostatic latent image formed on the surface of the photoreceptor body. Thus, the electrostatic latent image is developed into the toner image.

In recent years, a toner including more uniform, more spherical and smaller size toner particles is increasingly used for forming a higher quality image by the image forming apparatus.

Where a toner including highly spherical toner particles is used, however, the friction between the developing roller and the amount regulating blade is reduced during the formation of the toner layer on the surface of the developing roller, thereby reducing the triboelectric charging efficiency. This may result in insufficient charging, so that a formed image is liable to have a reduced image density or suffer from fogging in a margin thereof.

For prevention of these inconveniences, it is conceivable to increase the contact pressure of the amount regulating blade as described, for example, in Patent Document 1. In this case, however, the frictional heat is increased, so that the toner is liable to adhere (fuse and stick) to the surface of the developing roller and a distal edge of the amount regulating blade. The adhesion of the toner may result in white streaking (density unevenness) in the formed image.

In recent years, there is a trend that the toner fixation temperature is set at a lower level to reduce the power consumption of the image forming apparatus, and a toner having a lower melting point for proper fixation at a lower temperature is increasingly used. However, the use of the lower-melting-point toner is more liable to cause the adhesion of the toner, resulting in the density unevenness.

Patent Document 2 proposes to provide a toner capturing/collecting section for capturing and collecting finely broken toner particles liable to adhere to the amount regulating blade, so that the adhesion of the finely broken toner particles can be suppressed.

However, this proposal is not effective for the toner yet to be finely broken. Therefore, it is impossible to prevent the adhesion of the highly spherical toner particles and the lower-melting-point toner particles.

Further, Patent Document 3 proposes to impart the developing roller with a heat conductivity of not less than 0.15 W/m·K to increase the heat releasability of the developing roller, whereby the increase in the surface temperature of the developing roller is suppressed to prevent the adhesion of the toner during the driving of the image forming apparatus.

CITATION LIST

Patent Documents

Patent Document 1: JP2008-145885A
Patent Document 2: JP2009-150949A
Patent Document 3: JP2002-189341A

SUMMARY OF THE INVENTION

Problem to be Solved by the Invention

In an examination actually performed to prove the aforementioned effect in Patent Document 3, the upper limit of the heat conductivity of the developing roller is 0.27 W/m·K in Example 3, and the heat conductivity at this level is still insufficient. Particularly, where the developing roller is used in combination with the lower-melting-point toner, the density unevenness cannot be prevented.

In Examples of Patent Document 3, the rubber of the developing roller is too soft with an Asker C hardness of not greater than 65 and a Type-A durometer hardness of not greater than 40. Where the developing roller is used in combination with the toner including highly spherical toner particles as described above, the formed image is liable to have a reduced image density or suffer from fogging in a margin thereof due to insufficient charging.

It is an object of the present invention to provide a roller which is free from imaging failures, for example, even if being used as a developing roller in combination with the toner including highly spherical toner particles or the lower-melting-point toner.

Solution to Problem

The present invention provides a roller which includes a tubular body made of a crosslinking product of a rubber composition containing a crosslinkable rubber component, and having a heat conductivity of not less than 0.4 W/m·K and not greater than 2.0 W/m·K and a Type-A durometer hardness of not less than 50 and not greater than 70.

Effects of the Invention

According to the present invention, the roller is free from imaging failures, for example, even if being used as a developing roller in combination with the toner including highly spherical toner particles or the lower-melting-point toner.

BRIEF DESCRIPTION OF THE DRAWING

The FIGURE is a perspective view illustrating an exemplary roller according to one embodiment of the present invention.

EMBODIMENTS OF THE INVENTION

A roller according to the present invention includes a tubular body made of a crosslinking product of a rubber composition containing a crosslinkable rubber component, and having a heat conductivity of not less than 0.4 W/m·K and not greater than 2.0 W/m·K and a Type-A durometer hardness of not less than 50 and not greater than 70.

In the present invention, the heat conductivity and the Type-A durometer hardness of the roller are limited to the aforementioned ranges for the following reasons:

If the heat conductivity of the roller is less than 0.4 W/m·K, the heat conductivity is insufficient as in the case of the prior-art roller described in Patent Document 2. Particularly, where the roller is used as a developing roller in combination with the lower-melting-point toner, for example, white streaking (density unevenness) is liable to occur due to the adhesion of the toner.

If the Type-A durometer hardness is greater than 70, the roller will be too hard. Therefore, a coating agent or the like covering surfaces of the toner particles is liable to be removed during the triboelectric charging. With the coating agent or the like removed, a binder resin of the toner is exposed in surfaces of the toner particles, so that the toner is liable to adhere to the surface of the developing roller and the distal edge of the amount regulating blade. The adhesion of the toner may result in white streaking (density unevenness).

In order to impart the roller with a heat conductivity of greater than 2.0 W/m·K, a heat conducting component such as carbon fibers and graphite should be added in a great amount to the rubber composition (material for the roller). Therefore, the roller becomes too hard with a Type-A durometer hardness of higher than 70, and is liable to suffer from the adhesion of the toner, resulting in white streaking (density unevenness).

If the Type-A durometer hardness is less than 50, the roller is too soft as in the case of the prior-art roller described in Patent Document 2. Particularly, where the roller is used in combination with the toner including highly spherical toner particles, a formed image is liable to have a reduced image density or suffer from fogging in a margin thereof due to insufficient charging.

Where the roller has a heat conductivity of not less than 0.4 W/m·K and not greater than 2.0 W/m·K and a Type-A durometer hardness of not less than 50 and not greater than 70, in contrast, the roller to be used as the developing roller in combination with the toner including highly spherical toner particles or the lower-melting-point toner is free from the imaging failures.

For further improvement of the aforementioned effects, the heat conductivity of the roller is preferably not less than 0.41 W/m·K, particularly preferably not less than 1.1 W/m·K in the aforementioned range.

The Type-A durometer hardness of the roller is preferably not less than 53 and not greater than 67, particularly preferably not less than 58.

In the present invention, the heat conductivity and the Type-A durometer hardness of the roller are measured in the following manner:

<Measurement of Heat Conductivity>

A rubber composition to be used as the material for the roller is press-formed at 160° C. for 30 minutes to prepare a sheet having a length of 150 mm, a width of 50 mm and a thickness of 4 mm. The sheet is allowed to stand still in an environment at a standard test temperature of 23° C.±2° C. at a standard test relative humidity of 55±2% (hereinafter referred to as "standard test environment") for not shorter than 24 hours, and then the heat conductivity of the sheet is measured in the same standard test environment by a probe method. The heat conductivity thus measured is defined as the heat conductivity of the roller.

<Measurement of Type-A Durometer Hardness>

In the standard test environment, opposite end portions of a shaft projecting from opposite ends of the roller are fixed to a support base. In this state, an indenter point of a Type-A durometer conforming to Japanese Industrial Standards JIS K6253-3:2012 is pressed against a widthwise middle portion of the roller from above, and the type-A durometer hardness of the roller is measured with a load of 1 kg for a measurement period of 3 seconds (standard measurement period for vulcanized rubber).

<<Rubber Composition>>

The rubber composition as the material for the inventive roller contains at least the crosslinkable rubber component.

<Rubber Component>

Exemplary rubbers for the rubber component include a styrene butadiene rubber (SBR), an acrylonitrile butadiene rubber (NBR), a butadiene rubber (BR), a chloroprene rubber (CR), an acryl rubber, and an ethylene propylene diene rubber (EPDM), which may be used alone or in combination.

Particularly, the NBR is preferred.

The NBR is classified in a lower acrylonitrile content type, an intermediate acrylonitrile content type, an intermediate to higher acrylonitrile content type, a higher acrylonitrile content type or a very high acrylonitrile content type depending on the acrylonitrile content. Any of these types of NBRs is usable.

The NBRs include those of an oil-extension type having flexibility controlled by addition of an extension oil, and those of a non-oil-extension type containing no extension oil. Particularly, where the inventive roller is used as the developing roller for an image forming apparatus, as described above, a non-oil-extension type NBR is preferably used for prevention of contamination of a photoreceptor body.

These NBRs may be used alone or in combination.

<Heat Conducting Component>

In order to adjust the heat conductivity of the roller in the aforementioned range, the heat conducting component is preferably blended in the rubber composition.

Examples of the heat conducting component include carbon fibers, graphite, carbon black and graphene, which may be used alone or in combination. Particularly, the carbon fibers (which may hereinafter include two or more types of carbon fibers) are preferably used alone or in combination with the graphite.

The carbon fibers and the graphite have a smaller rubber reinforcing effect, i.e., a smaller rubber hardening effect, and a greater heat conductivity increasing effect than the carbon black. Therefore, even addition of a smaller amount of the carbon fibers and/or the graphite makes it possible to control the heat conductivity of the roller at a higher level within the aforementioned heat conductivity range, while maintaining the Type-A durometer hardness of the roller at a lower level within the aforementioned hardness range.

The carbon fibers and the graphite are more easily available at lower costs than the graphene which is a constituent of the graphite, thereby improving the productivity of the inventive roller and reducing the costs.

Usable examples of the carbon fibers include various fibrous carbon materials. Particularly, single-layer or multi-layer carbon nano-tubes (including carbon nano-fibers) are preferred in terms of heat conductivity. A specific example of the carbon nano-tubes is VGCF (registered trade name) H available from Showa Denko K.K.

The carbon fibers such as the carbon nano-tubes have a smaller rubber hardening effect and a greater heat conductivity increasing effect than the other heat conducting materials. Therefore, only the carbon fibers are preferably blended as the heat conducting component in the rubber composition for the properties of the roller.

Where only the carbon fibers are blended as the heat conducting component, the proportion of the carbon fibers is preferably not less than 5 parts by mass and not greater than 70 parts by mass based on 100 parts by mass of the overall rubber component.

If the proportion of the carbon fibers is less than the aforementioned range, it will be impossible to sufficiently improve the heat conductivity of the roller. If the proportion of the carbon fibers is greater than the aforementioned range, the roller will be too hard with a Type-A durometer hardness of greater than 70 and, therefore, is liable to suffer from the adhesion of the toner, resulting in white streaking (density unevenness).

Where the proportion of the carbon fibers to be blended falls within the aforementioned range, it is possible to improve the heat conductivity as much as possible while substantially preventing the roller from becoming too hard.

For further improvement of this effect, the proportion of the carbon fibers to be blended is preferably not less than 30 parts by mass within the aforementioned range.

The carbon fibers such as the carbon nano-tubes are mass-produced to cope with recent increased demand, but are still more expensive and more difficult to obtain than the graphite though not as expensive and difficult to obtain as the graphene.

For further improvement of the productivity of the inventive roller and for further cost reduction, it is preferred to use the graphite in combination with the carbon fibers to reduce the proportion of the carbon fibers to smaller than the aforementioned range.

A natural graphite or a synthetic graphite (artificial graphite) may be used as the graphite. Particularly, the natural graphite is more preferred for heat conductivity. That is, the synthetic graphite is liable to have defects in its outermost surface due to a problem associated with a production process, and have a lower heat conductivity than the natural graphite. In order to improve the heat conductivity by addition of a smaller amount of graphite, the natural graphite is more preferred.

Examples of the natural graphite include SNO series and SNE series graphites available from SEC Carbon, Ltd. Examples of the synthetic graphite include SGP series, SGO series, SGX series and SGL series graphites available from SEC Carbon, Ltd.

These graphites may be used alone or in combination.

Where the graphite is used in combination with the carbon fibers, the proportion of the graphite to be blended is preferably not less than 1 part by mass and not greater than 10 parts by mass based on 100 parts by mass of the overall rubber component.

If the proportion of the graphite is less than the aforementioned range, it will be impossible to sufficiently provide the effect of the combinational use of the graphite and the carbon fibers for improving the productivity of the roller and reducing the costs. Further, it will be impossible to sufficiently improve the heat conductivity of the roller, depending on the proportion of the carbon fibers.

If the proportion of the graphite is greater than the aforementioned range, on the other hand, the roller will be too hard with a Type-A durometer hardness of higher than 70, depending on the proportion of the carbon fibers. Therefore, the roller is liable to suffer from the adhesion of the toner, resulting in white streaking (density unevenness).

Where the proportion of the graphite to be blended falls within the aforementioned range, in contrast, it is possible to improve the productivity of the roller and reduce the costs, and to improve the heat conductivity as much as possible while substantially preventing the roller from becoming too hard.

For further improvement of these effects, the proportion of the graphite to be used in combination with the carbon fibers is preferably not less than 6 parts by mass within the aforementioned range based on 100 parts by mass of the overall rubber component.

The proportion of the carbon fibers to be used in combination with the graphite is preferably not less than 1 part by mass and not greater than 65 parts by mass based on 100 parts by mass of the overall rubber component.

If the proportion of the carbon fibers is less than the aforementioned range, even the combinational use of the carbon fibers and the graphite will fail to sufficiently improve the heat conductivity of the roller. If the proportion of the carbon fibers is greater than the aforementioned range, it will be impossible to sufficiently provide the effect of the combinational use of the carbon fibers and the graphite for improving the productivity of the roller and reducing the costs. Further, the roller will be too hard with a Type-A durometer hardness of higher than 70, depending on the proportion of the graphite. Therefore, the roller is liable to suffer from the adhesion of the toner, resulting in white streaking (density unevenness).

Where the proportion of the carbon fibers to be blended falls within the aforementioned range, in contrast, it is possible to improve the productivity of the roller and reduce the costs, and to improve the heat conductivity as much as possible while substantially preventing the roller from becoming too hard.

For further improvement of these effects, the proportion of the carbon fibers to be used in combination with the graphite is preferably not less than 20 parts by mass and not greater than 60 parts by mass within the aforementioned range based on 100 parts by mass of the overall rubber component.

Further, the mass ratio G/F of the graphite G to the carbon fibers F is preferably G/F=0.1 to 1.

If the mass ratio G/F is smaller than the aforementioned mass ratio range (the mass ratio of the graphite is smaller and the mass ratio of the carbon fibers is greater) even with the proportions of the graphite and the carbon fibers falling within the aforementioned ranges, it will be impossible to sufficiently provide the effect of the combinational use of the carbon fibers and the graphite for improving the productivity of the roller and reducing the costs.

If the mass ratio G/F is greater than the aforementioned mass ratio range (the mass ratio of the graphite is greater and the mass ratio of the carbon fibers is smaller) even with the proportions of the graphite and the carbon fibers falling within the aforementioned ranges, the roller will be too hard with a Type-A durometer hardness of higher than 70 and, therefore, is liable to suffer from the adhesion of the toner, resulting in white streaking (density unevenness). Further, it will be impossible to sufficiently improve the heat conductivity of the roller, depending on the proportion of the graphite to be blended.

Where the mass ratio G/F falls within the aforementioned mass ratio range, in contrast, it is possible to improve the productivity of the roller and reduce the costs, and to improve the heat conductivity as much as possible while substantially preventing the roller from becoming too hard.

For further improvement of these effects, the mass ratio G/F is preferably G/F≥0.2 within the aforementioned mass ratio range.

<Electrically Conductive Agent>

Where the inventive roller is used as the developing roller, an electrically conductive agent may be blended in the rubber composition to impart the roller with the electrical conductivity.

Examples of the electrically conductive agent include: carbon-containing electrically-conductive agents such as electrically conductive carbon black and carbon; fine metal particles such as of silver, copper and nickel; fine metal oxide particles such as of zinc oxide, tin oxide and titanium oxide; metal fibers and whiskers such as of aluminum and stainless steel; and glass beads and synthetic fibers coated with metals to be imparted with electrical conductivity. These electrically conductive agents may be used alone or in combination.

Where the carbon fibers and the graphite are used as the heat conducting component, the carbon fibers and the graphite also function as the electrically conductive agent. In order to simplify the formulation of the rubber composition and to prevent the roller from becoming too hard, it is particularly preferred to blend only the carbon fibers or only the carbon fibers and the graphite without blending the other electrically conductive agent.

<Crosslinking Component>

The rubber composition contains a crosslinking component for crosslinking the rubber component. The crosslinking component includes a crosslinking agent, an accelerating agent and the like.

Examples of the crosslinking agent include a sulfur crosslinking agent, a thiourea crosslinking agent, a triazine crosslinking agent, a peroxide crosslinking agent and monomers, which may be used alone or in combination according to the type of the rubber component.

Where the rubber component is the NBR, for example, the sulfur crosslinking agent is preferred.

Examples of the sulfur crosslinking agent include sulfur such as sulfur powder and organic sulfur-containing compounds such as tetramethylthiuram disulfide and N,N-dithiobismorpholine, which may be used alone or in combination.

Particularly, the sulfur is preferred.

The proportion of the sulfur to be blended is preferably not less than 0.2 parts by mass and not greater than 3 parts by mass, particularly preferably not less than 0.4 parts by mass and not greater than 2 parts by mass, based on 100 parts by mass of the overall rubber component.

Examples of the accelerating agent include inorganic accelerating agents such as lime, magnesia (MgO) and litharge (PbO), and organic accelerating agents, which may be used alone or in combination.

Examples of the organic accelerating agents include: guanidine accelerating agents such as 1,3-di-o-tolylguanidine, 1,3-diphenylguanidine, 1-o-tolylbiguanide and a di-o-tolylguanidine salt of dicatechol borate; thiazole accelerating agents such as 2-mercaptobenzothiazole and di-2-benzothiazolyl disulfide; sulfenamide accelerating agents such as N-cyclohexyl-2-benzothiazylsulfenamide; thiuram accelerating agents such as tetramethylthiuram monosulfide, tetramethylthiuram disulfide, tetraethylthiuram disulfide, tetrabutylthiuram disulfide and dipentamethylenethiuram tetrasulfide; and thiourea accelerating agents such as ethylene thiourea, which may be used alone or in combination.

Different types of accelerating agents have different functions and, therefore, are preferably used in combination.

The proportion of each of the accelerating agents to be blended may be properly determined depending on the type of the accelerating agent, but is typically not less than 0.1 part by mass and not greater than 5 parts by mass, particularly preferably not less than 0.2 parts by mass and not greater than 2 parts by mass, based on 100 parts by mass of the overall rubber component.

<Other Ingredients>

As required, various additives may be added to the rubber composition. Examples of the additives include a crosslinking assisting agent, a filler, an anti-aging agent, an anti-oxidant, an anti-scorching agent, a pigment, a flame retarder and defoaming agent.

Examples of the crosslinking assisting agent include: metal compounds such as zinc white; fatty acids such as stearic acid, oleic acid and cotton seed fatty acids; and other conventionally known crosslinking assisting agents, which may be used alone or in combination.

The proportion of each of the crosslinking assisting agents to be blended is preferably not less than 0.1 part by mass and not greater than 7 parts by mass, particularly preferably not less than 0.5 parts by mass and not greater than 5 parts by mass, based on 100 parts by mass of the overall rubber component.

The rubber composition containing the ingredients described above can be prepared in a conventional manner. First, the rubber component is simply kneaded, and additives other than the crosslinking component are added to and kneaded with the rubber component. Then, the crosslinking component is finally added to and further kneaded with the resulting mixture. Thus, the rubber composition is prepared.

A kneader, a Banbury mixer, an extruder or the like, for example, is usable for the kneading.

<<Roller>>

The FIGURE is a perspective view illustrating an exemplary roller according to one embodiment of the present invention.

Referring to the FIGURE, the roller 1 according to this embodiment includes a tubular body having a single layer structure including a single nonporous layer formed from the aforementioned rubber composition, and a shaft 3 is inserted through and fixed to a center through-hole 2 of the tubular body.

The shaft 3 is preferably made of a metal in order to speedily release frictional head and the like from the roller 1 and to provide electrical connection to the roller 1 when the roller 1 is used as the developing roller.

Examples of the metal shaft 3 include shafts unitarily formed of aluminum, an aluminum alloy and stainless steel.

Where the roller 1 is used as the developing roller, the shaft 3 is electrically connected to and mechanically fixed to the roller 1, for example, via an electrically conductive adhesive agent. Alternatively, a shaft having an outer diameter that is greater than the inner diameter of the through-hole 2 is used as the shaft 3, and press-inserted into the through-hole 2 to be electrically connected to and mechanically fixed to the roller 1. Thus, the shaft 3 and the roller 1 are unitarily rotatable.

Where the roller 1 is used as the developing roller, the roller 1 may have an oxide film provided in an outer peripheral surface 4 thereof.

The oxide film thus provided functions as a dielectric layer to reduce the dielectric dissipation factor of the roller 1. Further, the oxide film serves as a lower friction layer to suppress the adhesion of the toner.

In addition, the oxide film can be easily formed, for example, by irradiation with ultraviolet radiation in an oxidizing atmosphere, thereby suppressing the reduction in the productivity of the roller 1 and the increase in production costs. However, the oxide film may be obviated.

For the production of the roller 1, the rubber composition preliminarily prepared is first extruded into a tubular body by means of an extruder. Then, the tubular body is cut to a predetermined length, and heated in a vulcanization can to crosslink the rubber component.

In turn, the tubular body thus crosslinked is heated in an oven for secondary crosslinking, then cooled, and polished to a predetermined outer diameter.

Various polishing methods such as dry traverse polishing method may be used for the polishing. Where the outer peripheral surface 4 of the roller 1 is mirror-polished at the end of the polishing step, the releasability of the outer peripheral surface 4 is improved. Where the roller 1 having the mirror-polished outer peripheral surface 4 is used as the developing roller, for example, the adhesion of the toner can be suppressed. In addition, the contamination of the photoreceptor body can be further effectively prevented.

Where the oxide film is formed after the mirror-polishing of the outer peripheral surface 4, as described above, the synergistic effect of the mirror-polishing and the oxide film further advantageously suppresses the adhesion of the toner, and further advantageously prevents the contamination of the photoreceptor body.

The shaft 3 may be inserted into and fixed to the through-hole 2 at any time between the end of the cutting of the tubular body and the end of the polishing.

However, the tubular body is preferably secondarily crosslinked and polished with the shaft 3 inserted through the through-hole 2 after the cutting. This prevents warpage and deformation of the roller 1 which may otherwise occur due to expansion and contraction of the tubular body in the secondary crosslinking. Further, the tubular body may be polished while being rotated about the shaft 3. This improves the working efficiency in the polishing, and suppresses deflection of the outer peripheral surface 4.

As previously described, the shaft 3 may be inserted through the through-hole 2 of the tubular body with the intervention of an electrically conductive adhesive agent (particularly a thermosetting adhesive agent) before the secondary crosslinking, or the shaft 3 having an outer diameter greater than the inner diameter of the through-hole 2 may be press-inserted into the through-hole 2.

In the former case, the thermosetting adhesive agent is cured when the tubular body is secondarily crosslinked by the heating in the oven. Thus, the shaft 3 is electrically connected to and mechanically fixed to the roller 1.

In the latter case, the electrical connection and the mechanical fixing are achieved simultaneously with the press insertion.

As required, the outer peripheral surface 4 is thereafter oxidized in the aforementioned manner, whereby the oxide film is formed in the outer peripheral surface 4. Thus, the inventive roller 1 is completed.

The inventive roller 1 may have a double-layer structure which includes an outer layer provided on the side of the outer peripheral surface 4 and an inner layer provided on the side of the shaft 3. Further, the roller 1 may have a porous structure.

However, the roller 1 preferably has a nonporous single-layer structure for simplification of the structure for production of the roller at lower costs with higher productivity, for improvement of durability and for minimization of compression set.

The term "single-layer structure" herein means that the roller includes a single layer formed from the rubber composition and the oxide film formed by the oxidation process is not counted.

The inventive roller 1 can be advantageously used not only as the developing roller but also as a charging roller, a transfer roller, a cleaning roller or the like, for example, in an electrophotographic image forming apparatus such as a laser printer, an electrostatic copying machine, a plain paper facsimile machine or a printer-copier-facsimile multifunction machine.

EXAMPLES

Example 1

Preparation of Rubber Composition

An NBR (lower-acrylonitrile content NBR of non-oil-extension type, JSR (registered trade name) N250SL available from JSR Co., Ltd., and having an acrylonitrile content of 19.5%) was used as a rubber component.

While 100 parts by mass of the rubber component was simply kneaded by means of a Banbury mixer, 8 parts by mass of carbon fibers (carbon nano-tubes VGCF-H available from Showa Denko K.K.) as a heat conducting component and 5 parts by mass of zinc white (Zinc Oxide Type-2 available from Mitsui Mining & Smelting Co., Ltd.) as a crosslinking assisting agent were added to the rubber component, and then the resulting mixture was further kneaded.

While the mixture was continuously kneaded, the following crosslinking component was added to the mixture, which was in turn further kneaded. Thus, a rubber composition was prepared.

TABLE 1

| Crosslinking component | Parts by mass |
|---|---|
| Crosslinking agent | 0.50 |
| Accelerating agent TS | 0.50 |
| Accelerating agent DM | 0.50 |
| Accelerating agent 22 | 0.33 |
| Accelerating agent DT | 0.28 |

The ingredients shown in Table 1 are as follows. The amounts (parts by mass) shown in Table 1 are based on 100 parts by mass of the overall rubber component. Crosslinking agent: 5% Oil-containing sulfur (available from Tsurumi Chemical Industry Co., Ltd.)

Accelerating agent TS: Tetramethylthiuram monosulfide (SANCELER (registered trade name) TS available from Sanshin Chemical Industry Co., Ltd.)

Accelerating agent DM: Di-2-benzothiazolyl disulfide (ACCEL (registered trade name) DM available from Kawaguchi Chemical Industry Co., Ltd.)

Accelerating agent 22: Ethylene thiourea (2-mercaptoimidazoline) ACCEL 22-S available from Kawaguchi Chemical Industry Co., Ltd.

Accelerating agent DT: 1,3-di-o-tolylguanidine (SANCELER DT available from Sanshin Chemical Industry Co., Ltd.)

(Production of Roller)

The rubber composition thus prepared was fed into an extruder, and extruded into a cylindrical tubular body having an outer diameter of 17 mm and an inner diameter of 6.5 mm. Then, the tubular body was fitted around a crosslinking shaft, and crosslinked in a vulcanization can at 160° C. for 1 hour.

Then, the crosslinked tubular body was removed from the crosslinking shaft, then fitted around a metal shaft having an outer diameter of 7.0 mm and an outer peripheral surface to which an electrically conductive thermosetting adhesive agent was applied, and heated to 160° C. in an oven. Thus, the tubular body was bonded to the shaft. In turn, opposite end portions of the tubular body were cut.

Then, the outer peripheral surface of the resulting tubular body was polished by a traverse polishing method by means of a cylindrical polishing machine, and mirror-polished with a #1000 film and then with a #2000 film (available from Sankyo Rikagaku Co., Ltd.) Thus, a roller having an outer diameter of 16.00 mm (with a tolerance of 0.05) was produced.

Examples 2 and 3 and Comparative Examples 1 and 2

Rubber compositions were prepared in substantially the same manner as in Example 1, except that the carbon fibers were blended in proportions of 4 parts by mass (Comparative Example 1), 30 parts by mass (Example 2), 70 parts by mass (Example 3) and 75 parts by mass (Comparative Example 2) based on 100 parts by mass of the overall rubber component. Then, rollers were produced by using the rubber compositions thus prepared.

Example 4

A rubber composition was prepared in substantially the same manner as in Example 1, except that 5 parts by mass of the carbon fibers and 5 parts by mass of a natural graphite (SNE-6G available from SEC Carbon, Ltd.) were used in combination based on 100 parts by mass of the overall rubber component. Then, a roller was produced by using the rubber composition thus prepared.

The mass ratio G/F was G/F=1.

Example 5

A rubber composition was prepared in substantially the same manner as in Example 4, except that the proportion of the carbon fibers was 60 parts by mass and the proportion of the natural graphite was 6 parts by mass based on 100 parts by mass of the overall rubber component. Then, a roller was produced by using the rubber composition thus prepared.

The mass ratio G/F was G/F=0.1.

Comparative Example 3

A rubber composition was prepared in substantially the same manner as in Example 4, except that the proportion of the carbon fibers was 30 parts by mass and the proportion of the natural graphite was 35 parts by mass based on 100 parts by mass of the overall rubber component. Then, a roller was produced by using the rubber composition thus prepared.

The mass ratio G/F was G/F=1.17.

Example 6

A rubber composition was prepared in substantially the same manner as in Example 1, except that carbon black (ISAF SEAST 6 available from Tokai Carbon Co., Ltd.) was blended instead of the carbon fibers in a proportion of 17 parts by mass based on 100 parts by mass of the overall rubber component. Then, a roller was produced by using the rubber composition thus prepared.

Comparative Examples 4 to 6

Rubber compositions were prepared in substantially the same manner as in Example 6, except that the carbon black was blended in proportions of 2 parts by mass (Comparative Example 4), 10 parts by mass (Comparative Example 5) and 45 parts by mass (Comparative Example 6) based on 100 parts by mass of the overall rubber component. Then, rollers were produced by using the rubber compositions thus prepared.

<Measurement of Heat Conductivity>

The heat conductivities of the rollers of Examples 1 to 6 and Comparative Examples 1 to 6 were determined by the aforementioned measurement method.

That is, the rubber compositions prepared in Examples and Comparative Examples were press-formed at 160° C. for 30 minutes to prepare sheets each having a length of 150 mm, a width of 50 mm and a thickness of 4 mm. These sheets were allowed to stand still in the standard test environment for not shorter than 24 hours, and then the heat conductivities of the sheets were measured in the same standard test environment by a probe method employing a probe-type heat conductivity measuring apparatus (Kemtherm QTM-D3 available from Kyoto Electronics Manufacturing Co., Ltd.) and a probe (QTM-PD3 available from Kyoto Electronics Manufacturing Co., Ltd.)

<Measurement of Type-A Durometer Hardness>

The Type-A durometer hardnesses of the rollers produced in Examples 1 to 6 and Comparative Examples 1 to 6 were measured under the aforementioned measurement conditions in the standard test environment by the aforementioned measurement method.

<Actual Machine Test>

The rollers produced in Examples 1 to 6 and Comparative Examples 1 to 6 were each incorporated as a developing roller in a toner cartridge of a commercially available laser printer using a lower-melting-point toner including highly spherical toner particles. Then, a 5% density image was outputted in the standard test environment by the laser printer. The output image was checked for white streaking (density unevenness) occurring due to adhesion of the toner, and evaluated based on the following criteria.

○ (Excellent): No density unevenness was observed.

Δ (Acceptable): Slight density unevenness visually unperceivable was observed.

x (Unacceptable): Distinct density unevenness visually perceivable was observed.

The results are shown in Tables 2 to 4.

TABLE 2

| | Comparative Example 1 | Example 1 | Example 2 | Example 3 | Comparative Example 2 |
|---|---|---|---|---|---|
| Parts by mass | | | | | |
| Carbon fibers | 4 | 8 | 30 | 70 | 75 |
| Natural graphite | — | — | — | — | — |
| Carbon black | — | — | — | — | — |
| Evaluation | | | | | |
| Type-A hardness | 52 | 53 | 58 | 67 | 72 |
| Heat conductivity (W/m · K) | 0.29 | 0.41 | 1.1 | 1.99 | 2.2 |
| Density unevenness | x | Δ | ○ | ○ | x |

TABLE 3

| | Comparative Example 3 | Example 4 | Example 5 |
|---|---|---|---|
| Parts by mass | | | |
| Carbon fibers F | 30 | 5 | 60 |
| Natural graphite G | 35 | 5 | 6 |
| Carbon black | — | — | — |
| Mass ratio G/F | 1.17 | 1 | 0.1 |
| Evaluation | | | |
| Type-A hardness | 76 | 56 | 66 |
| Heat conductivity (W/m · K) | 1.49 | 0.42 | 1.72 |
| Density unevenness | x | Δ | ○ |

TABLE 4

| | Comparative Example 4 | Comparative Example 5 | Example 6 | Comparative Example 6 |
|---|---|---|---|---|
| Parts by mass | | | | |
| Carbon fibers | — | — | — | — |
| Natural graphite | — | — | — | — |
| Carbon black | 2 | 10 | 17 | 45 |
| Evaluation | | | | |
| Type-A hardness | 51 | 62 | 69 | 95 |
| Heat conductivity (W/m · K) | 0.23 | 0.32 | 0.40 | 0.70 |
| Density unevenness | x | x | Δ | x |

The results for Examples 1 to 6 and Comparative Examples 1 to 6 in Tables 2 to 4 indicate that, where the roller is imparted with a heat conductivity of not less than 0.4 W/m·K and not greater than 2.0 W/m·K and a Type-A durometer hardness of not less than 50 and not greater than 70 by blending the heat conducting component such as the carbon fibers, the graphite and/or the carbon black in the rubber composition, it is possible to suppress the adhesion of the toner and hence the white streaking (density unevenness).

The results for Examples 1 to 5 and Comparative Examples 1 to 3 and the results for Example 6 and Comparative Examples 4 to 6 indicate that the carbon fibers or the carbon fibers plus the graphite employed as the heat conducting component advantageously provide a smaller rubber reinforcing effect and a greater heat conductivity improving effect than the carbon black and, therefore, even the addition of a smaller amount of the carbon fibers or the carbon fibers plus the graphite makes it possible to control the heat conductivity of the roller at a higher level within the aforementioned heat conductivity range while maintaining the Type-A durometer hardness of the roller at a lower level within the aforementioned hardness range.

The results for Examples 1 to 3 and Comparative Examples 1 and 2 indicate that the proportion of the carbon fibers to be used alone as the heat conducting component is preferably not less than 5 parts by mass and not greater than 70 parts by mass, particularly preferably not less than 30 parts by mass, based on 100 parts by mass of the overall rubber component.

The results for Examples 4 and 5 and Comparative Example 3 indicate that, where the carbon fibers and the graphite are used in combination as the heat conducting component, the proportion of the graphite to be blended is preferably not less than 1 part by mass and not greater than 10 parts by mass, particularly preferably not less than 6 parts by mass, based on 100 parts by mass of the overall rubber component, and the proportion of the carbon fibers to be blended is preferably not less than 1 part by mass and not greater than 65 parts by mass, particularly preferably not less than 20 parts by mass and not greater than 60 parts by mass, based on 100 parts by mass of the overall rubber component, and the mass ratio G/F is preferably G/F=0.1 to 1, particularly preferably G/F≥0.2.

This application corresponds to Japanese Patent Application No. 2015-019576 filed in the Japan Patent Office on Feb. 3, 2015, the disclosure of which is incorporated herein by reference in its entirety.

What is claimed is:

1. A roller comprising a tubular main body made of a crosslinked product of a rubber composition containing a crosslinkable rubber component, wherein the main body has a heat conductivity in the range of 0.4 W/m·K to 2.0 W/m·K and a Type-A durometer hardness in the range of 50 to 70, wherein the rubber composition further contains from 1 part by mass to 10 parts by mass of graphite and from 1 part by mass to 65 parts by mass of carbon fibers based on 100 parts by mass of the overall rubber component, and wherein the graphite G and the carbon fibers F are present in a mass ratio of G/F=0.1 to 1.

2. The roller according to claim 1, wherein the rubber composition contains from 30 parts by mass to 65 parts by mass of carbon fibers based on 100 parts by mass of the overall rubber component.

3. The roller according to claim 1, further comprising a metal shaft inserted through the tubular main body.

4. An electrophotographic image forming apparatus comprising a roller according to claim 3 for use as a developing roller for developing an electrostatic latent image formed on a photoreceptor surface into a toner image.

* * * * *